US006309255B1

(12) United States Patent
Yu

(10) Patent No.: US 6,309,255 B1
(45) Date of Patent: Oct. 30, 2001

(54) ELECTRICAL CONNECTOR HAVING POWER CONTACTS FOR PROVIDING HIGH ELECTRICAL POWER

(75) Inventor: Yung-Ming Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,631

(22) Filed: Dec. 28, 2000

(30) Foreign Application Priority Data

Dec. 7, 2000 (TW) ..... 89221275

(51) Int. Cl.[7] ..... H01R 33/00
(52) U.S. Cl. ..... 439/660; 439/924.1; 439/101
(58) Field of Search ..... 439/660, 101, 439/607, 924.1, 108

(56) References Cited

U.S. PATENT DOCUMENTS 4,767,345 * 8/1988 Gutter et al. ..... 439/660
4,975,069 * 12/1990 Fedder et al. ..... 439/101
5,782,646 * 7/1998 Broadfield et al. ..... 439/607
5,812,660 * 9/1998 Suzuki et al. ..... 439/607
6,093,057 * 7/2000 Lok ..... 439/607

* cited by examiner

*Primary Examiner*—Tho D. Ta
(74) *Attorney, Agent, or Firm*—Wei Te Chung

(57) ABSTRACT

An electrical connector (1) includes an insulative housing (10), and a plurality of first contacts (20) and at least a second contact (30) respectively received within the housing. The first contacts have first body portions (22) aligned with each other within a plane, and the second contact has a second body portion (32). The second body portion is spaced from the plane by the housing. The second contact is thereby able to transfer high electrical power without creating signal interference between the first contacts and the second contact.

8 Claims, 3 Drawing Sheets

ELECTRICAL CONNECTOR HAVING POWER CONTACTS FOR PROVIDING HIGH ELECTRICAL POWER

BACKGROUND OF THE INVENTION

1. Field of the Invention

The present invention relates to an electrical connector, and particularly to a Universal Serial Bus (USB) electrical connector capable of providing a large amount of electrical power.

2. Description of Related Art

Some conventional Universal Serial Bus (USB) electrical connectors comprise first contacts and second contacts in an insulative housing for respectively transferring electronic data and electrical power. However, the first contacts and the second contacts are arranged near each other. Thus if high electrical power passes through the second contacts, signal interference will arise between the second contacts and the fire contacts. Nevertheless, users sometimes require much as 2.5 amps of electrical power.

In order to overcome this problem, users employ two different connectors for respectively transferring electronic data and electrical power. This solution runs against the trend toward miniaturization of electrical connectors and of computers generally.

Hence, an improved USB connector is required to overcome the disadvantages of the prior art.

BRIEF SUMMARY OF THE INVENTION

An object of the present invention is to provide an electrical connector capable of providing high electrical power and electronic data without generating signal interference.

To fulfill the above-mentioned object, an electrical connector of the present invention comprises an insulative housing, and a plurality of first contacts and at least a second contact respectively received within the housing. The first contacts have first body portions aligned with each other in a plane, and the second contact has a second body portion. The second body portion is spaced from the plane by the housing. The second contact is thereby able to transfer high electrical power without creating signal interference between the first contacts and the second contact.

Other objects, advantages and novel features of the invention will become more apparent from the following detailed description of the preferred embodiment when taken in conjunction with the accompanying drawings.

DETAILED DESCRIPTION OF THE INVENTION

Figure 1:
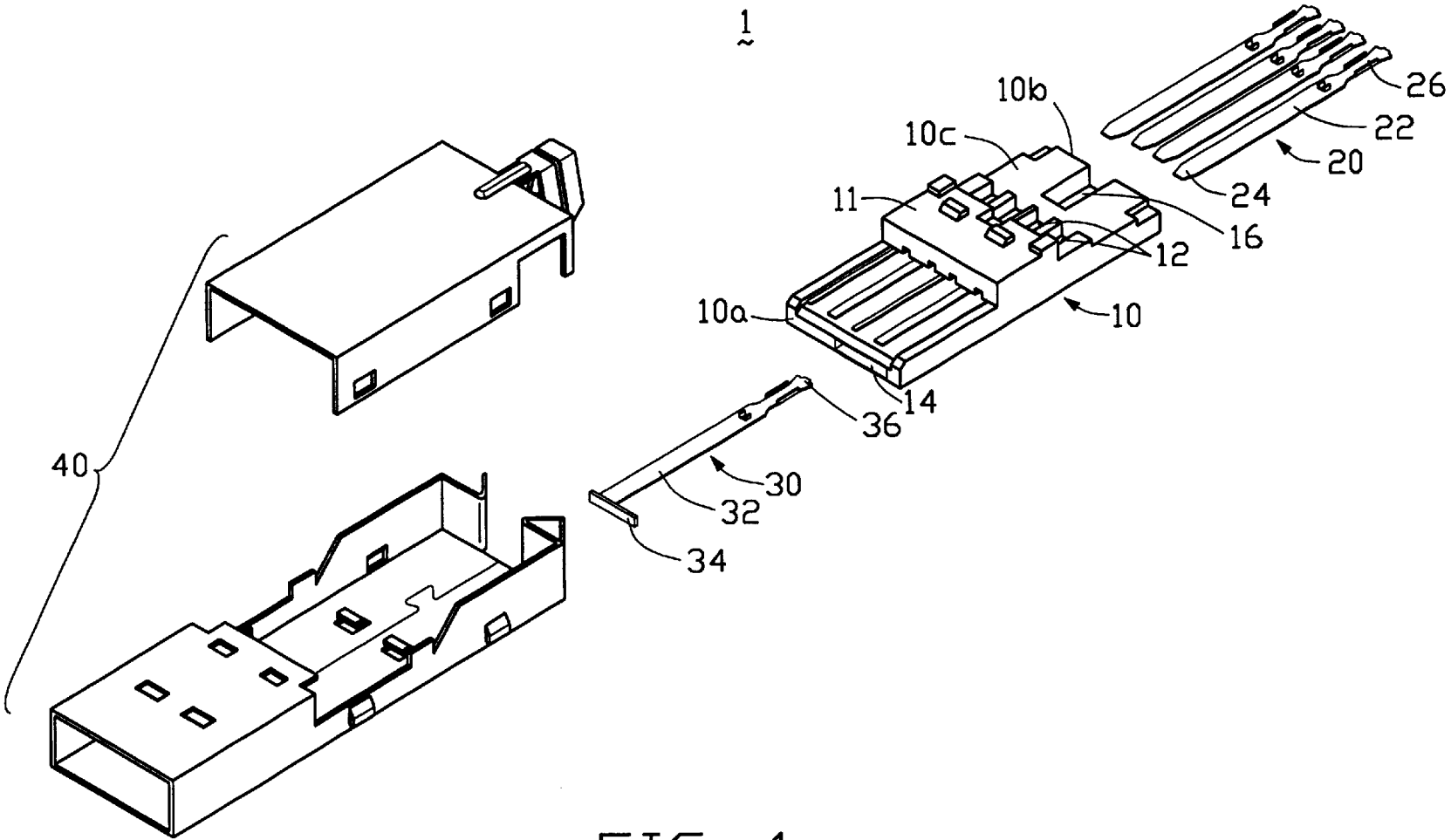
FIG. 1 is an exploded view of an electrical connector in accordance with the present invention.
Figure 2:
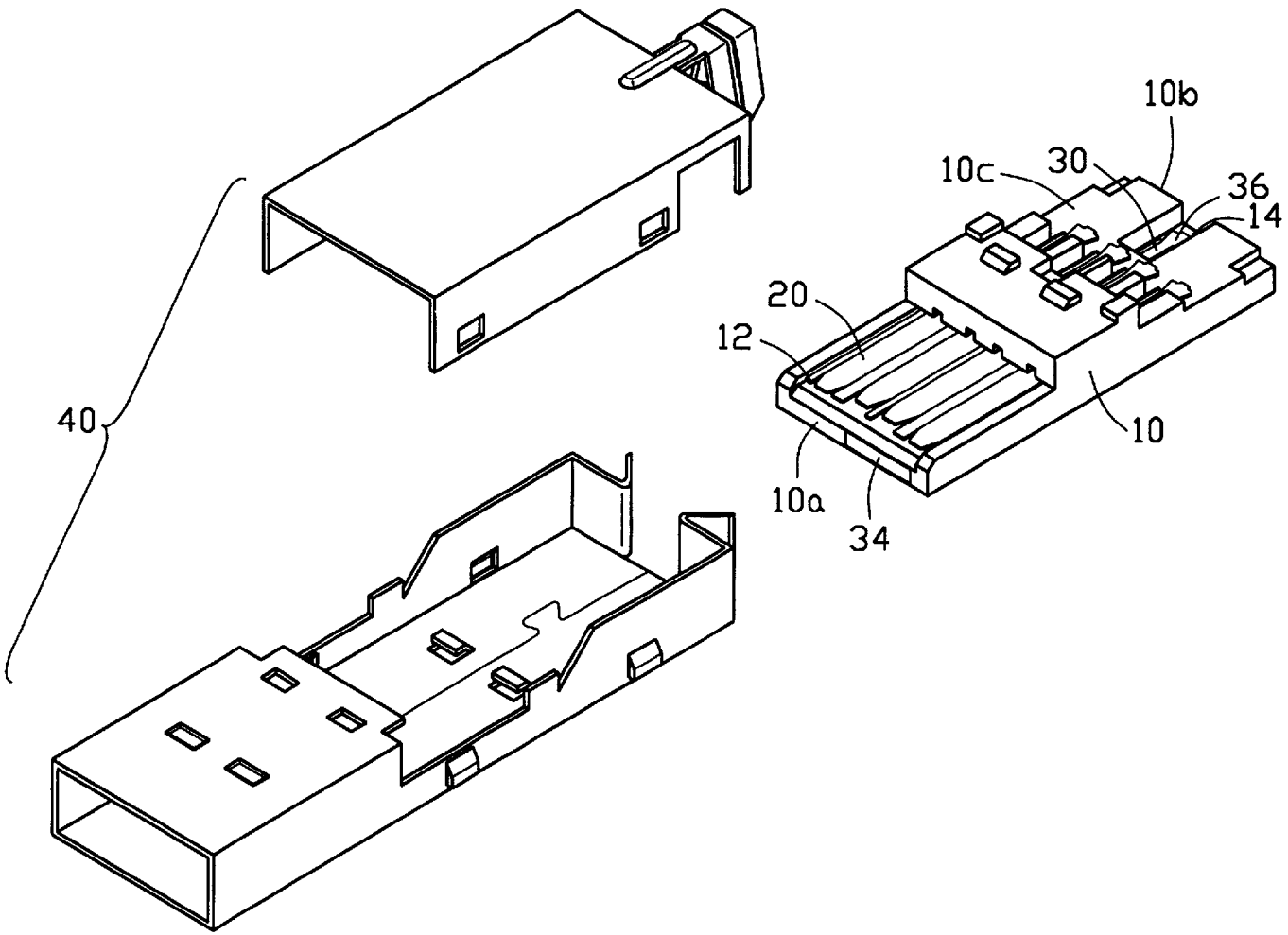
FIG. 2 is a partly assembled view of FIG. 1.

Referring to FIGS. 1 and 2, a Universal Serial Bus (USB) electrical connector 1 in accordance with the present invention comprises an elongated insulative housing 10, and a plurality of first contacts 20 and a second contact 30 respectively received within the housing 10. A two-piece shell 40 encloses outer faces of the housing 10 for providing shielding.

The housing 10 has a vertical first face 10*a*, a vertical second face 10*b* opposite to the first face 10*a*, and a horizontal third face 10*c* connecting the first face 10*a* and the second face 10*b*. A block 11 is formed in a middle portion of the housing 10 above and adjoining the third face 10*c*. A plurality of first receiving channels 12 is defined in the third face 10*c* and through the block 11 of the housing 10. The first receiving channels 12 are approximately in a first plane. A second receiving channel 14 is defined through the housing 10 between the first face 10*a* and the second face 10*b*. It is noted that the second receiving channel 14 is near a bottom face (not labeled) opposite to the third face 10*c* of the housing 10, below the first receiving channels 12. Thus the first receiving channels 12 and the second receiving channel 14 are spaced apart by the housing 10. The second receiving channel 14 has a widened portion thereof at the first face 10*a* of the housing 10, for accommodating the second contact 30. A recess 16 is defined in the third face 10*c* of the housing 10, in communication with the second receiving channel 14.

The first contacts 20 are commonly used to transfer electronic data. Each first contact 20 comprises an elongated flat first body portion 22, a first mating portion 24 at an end of the first body portion 22 for mating with a mating contact (not shown), and a first contacting portion 26 at an opposite end of the first body portion 22 for contacting with other components such as cables (not shown). It is noted that two longer contacts of the first contacts 20 can be used to transfer electrical power, too, but only electrical power which is less than electrical power which can be transferred by the second contact 30.

The second contact 30 is used to transfer electrical power, and comprises an elongated flat second body portion 32, a second mating portion 34 at an end of the second body portion 32 for mating with a mating contact (not shown), and a second contacting portion 36 at an opposite end of the second body portion 32 for contacting with other components such as a cable (not shown). The second mating portion 34 is a large flat plate perpendicularly offset from the second body portion 32, and is receivable in the widened portion of the second receiving channel 14 of the housing 10. The large flat plate configuration provides the mating portion 34 with a large pushing area and relatively small resistance per unit area when the mating portion 34 is mated with a mating contact of a mating connector (not shown).

Figure 3:
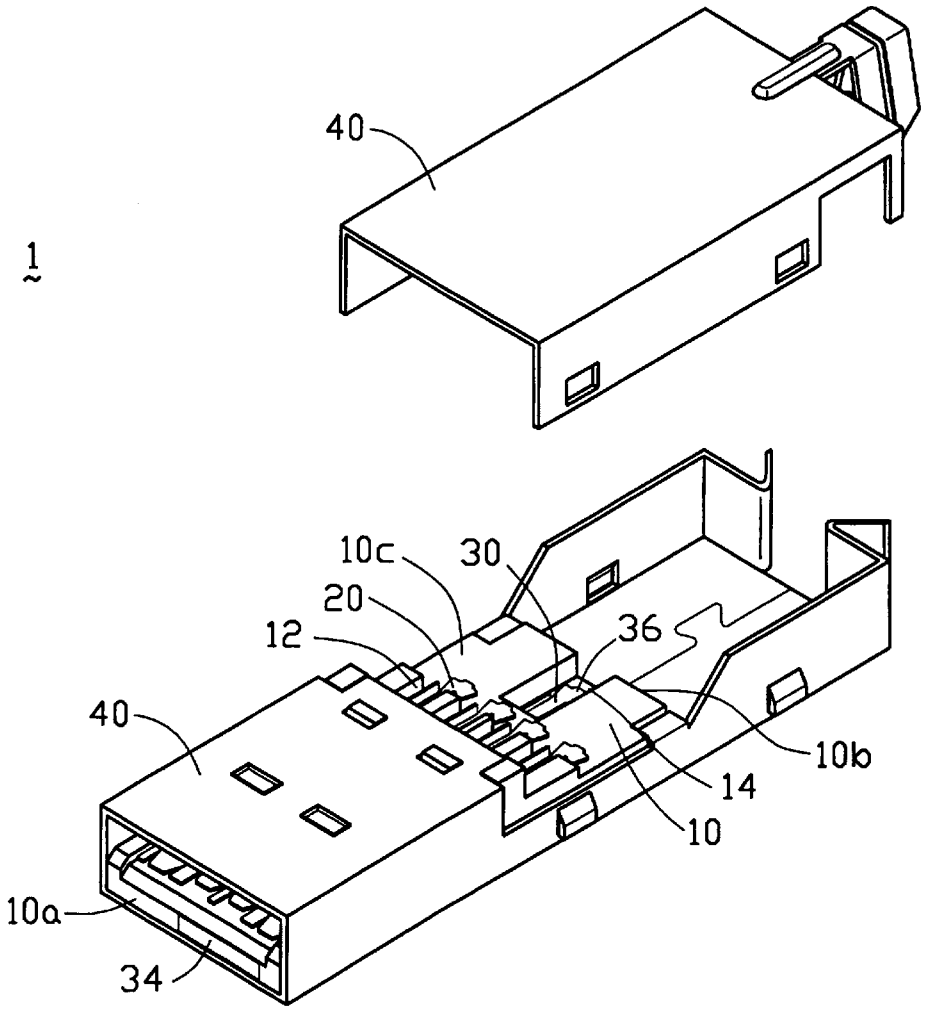
FIG. 3 is a more fully assembled view of FIG. 2.

Referring to FIGS. 1 to 3, in assembly, the first contacts 20 and the second contact 30 are respectively inserted into corresponding receiving channels 12 and 14 at the second face 10*b* and the first face 10*a* of the housing 10. The contacting portions 26, 36 of the first contacts 20 and the second contact 30 are soldered to corresponding cables. Finally, the two-piece shell 40 is assembled over the housing 10. Thus, an electrical connection is established between the cables and the mating connector.

An advantage of the electrical connector of the present invention is that the first contacts 20 and the second contact 30 are secured within a single insulative housing 10, yet spaced apart by the housing 10. In the preferred embodiment, signal interference between the first contacts 20 and the second contact 30 is avoided even when as much as 2.5 amps of electrical power passes through the second contact 30. Furthermore, the present invention combines two conventional connectors into a single connector, thereby providing a miniaturized electrical connector. Moreover, the electrical connector of the present invention is matable not only with a similar connector, but also with two separate connectors. That is, such similar connector has first contacts and a second contact in a single insulative housing, while such two separate connectors include a connector for transferring electronic data and a connector for transferring electrical power.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for transferring electronic data and electrical power, comprising:

an insulative housing having a first face, a second face opposite to the first face and a third face connecting the first and second faces, the housing defining a plurality of first receiving channels and at least one second receiving channel;

a plurality of first contacts used for transferring electronic data, each first contact having a first body portion, a first mating portion at an end of the body portion and a first contacting portion for contacting a cable at an opposite end of the body portion, the first contacts being inserted into the first receiving channels of the housing at the second face; and at least one second contact used for transferring electrical power, the at least one second contact having a second body portion, a second mating portion at an end of the body portion and a second contacting portion for contacting the cable at an opposite end of the second body portion, the at least one second contact being inserted into the corresponding second receiving channel of the housing at the first face, wherein the at least one second contact is spaced from every first contact by the housing;

wherein the receiving channels are defined in the third face of the housing and the second receiving channels is below the first receiving channels, near a bottom face of the housing opposite to the third face.

2. The electrical connector as claimed in claim 1, wherein the first receiving channels are generally aligned with each other in a plane.

3. The electrical connector as claimed in claim 1, wherein each second receiving channel is defined through the housing between the first face and the second face.

4. The electrical connector as claimed in claim 1, wherein after the first contacts are assembled to the housing, each first mating portion of the first contacts is near the first face of the housing and each first contacting portion of the first contacts is near the second face of the housing.

5. The electrical connector as claimed in claim 1, wherein the second mating portion of the second contact is a large flat plate perpendicularly offset from the second body portion of the second contact, and wherein after the second contact is inserted into the housing, an outer face of the second mating portion is generally coplanar with the first face of the housing, and the second contacting portion of the second contact is near the second face of the housing.

6. The electrical connector as claimed in claim 1, wherein the connector further comprises a two-piece shell enclosing outer faces of the housing except the first face and the second face.

7. An electrical connector assembly comprising:

an insulative housing receiving a plurality of first contacts for transferring electronic data and at least one second contact for transferring electrical power, said first contacts defining first mating portions thereon and first contacting portions opposite to the first mating portions for contacting a cable;

said at least one second contact spaced from the first contacts, and defining a second mating portion thereon and a second contacting portion offset from the second mating portion for contacting the same cable; wherein said first mating portions and the second mating portion extend perpendicular to each other, and said second contacting portion extends parallel to the first contacting portions while perpendicular to said second mating portion;

wherein the first contacts are located in a same plane while the second contact is located in another plane.

8. The assembly as claimed in claim 7, wherein said second contact is longer than the first contacts in a lengthwise direction of the housing.

* * * * *